United States Patent [19]

Martin

[11] 4,397,718

[45] Aug. 9, 1983

[54] ZINC PLATING BATHS WITH CONDENSATING POLYMER BRIGHTENERS

[75] Inventor: Sylvia Martin, Detroit, Mich.

[73] Assignee: Occidental Chemical Corporation, Warren, Mich.

[21] Appl. No.: 381,090

[22] Filed: May 24, 1982

[51] Int. Cl.[3] ..... C25D 3/22; C25D 3/24

[52] U.S. Cl. ..... 204/55 Y; 204/55 R

[58] Field of Search ..... 204/55 R, 55 Y, 43 Z, 204/43 T, 114, 123

[56] References Cited

U.S. PATENT DOCUMENTS 4,229,268 10/1980 Lowery et al. ..... 204/55 R

*Primary Examiner*—G. L. Kaplan

*Attorney, Agent, or Firm*—Richard P. Mueller

[57] ABSTRACT

A zinc plating bath comprises a conductive aqueous solution containing zinc ions and a brightening additive which is a derivative of $\beta$-aminopropionic acid or a polymer thereof. A ductile zinc deposit having a uniform high degree of brightness can be electrodeposited from the bath onto a substrate.

16 Claims, No Drawings

ZINC PLATING BATHS WITH CONDENSATING POLYMER BRIGHTENERS

BACKGROUND OF THE INVENTION

The present invention relates to the electrodeposition of zinc. More particularly, the present invention relates to improved compositions and processes for the electrodeposition of zinc from zinc plating baths comprising a water soluble derivative of $\beta$-aminopropionic acid.

Zinc plating baths and processes are employed for depositing a corrosion resistant and decorative plating deposit on a variety of substrates and are often used in conjunction with ferrous substrates such as iron or steel. In order to enchance the brightness of plating deposit, a variety of addition agents have been proposed and are used in zinc plating baths. The agents have been limited in use however, in that heretofore, no one additive could be employed in all types of zinc plating baths. In addition, the additives have generally been limited to use over relatively narrow current density ranges. Furthermore, the deposition of a zinc plate of high ductility has been difficult to obtain when using any one brightening additive.

The zinc plating bath and process of the present invention is an improvement over prior art baths and processes with regard to the above-mentioned disadvantages. Thus, in accordance with the present invention, a brightening additive is provided which can be used in a wide variety of types of zinc plating baths over broad pH and current density ranges to provide a bright zinc deposit having excellent ductility characteristics. Therefore, the zinc plating bath of the present invention is commercially useful and is characterized, in part, by its flexibility and versatility in use to obtain excellent zinc plating results.

A further understanding of the present invention will be obtained from the following description and examples thereof. Unless otherwise indicated, in the following description and examples, all parts and percents are by weight and all temperatures are in degrees Farenheit.

SUMMARY OF THE INVENTION

In accordance with the present invention, a zinc electroplating bath comprises a conductive aqueous solution containing zinc ions and a brightening amount of a soluble brightening additive selected from the group consisting of a monomer of the following general formula and polymers thereof:

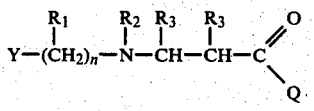

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

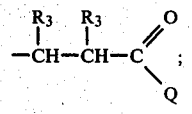

$R_3$ is H or an alkyl group having from 1 to about 4 carbon atoms, phenyl, substituted-phenyl, or

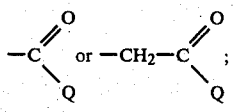

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

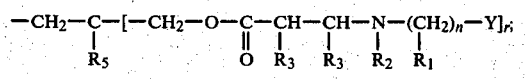

$R_5$ is H, —OH, or a hydroxyalkyl group having from 1 to about 4 carbon atoms;

r is 1 to about 3;

and mixtures thereof.

In accordance with the process of the present invention, a bright zinc plate is electroplated from the aforesaid electroplating bath.

DETAILED DESCRIPTION OF THE INVENTION

Generally speaking, the present invention pertains to zinc electroplating baths comprising an organic brightening additive as set forth herein and to processes employing zinc electroplating baths comprising said additive for electroplating a zinc deposit therefrom. An organic brightening additive of the present invention is a derivative of $\beta$-aminopropionic acid or a polymer thereof. Generally speaking, the organic additive used in this invention has a long working life and is effective over a wide current density range and a wide pH range. Furthermore, the additive is stable to relatively high temperatures even though the additive is an organic compound. Therefore, a zinc electroplating bath of this invention can be useful over a wide range of current density, pH and temperature and have a long working life.

Other than use of the aforementioned brightening agent, zinc baths of the present invention can comprise any of the ingredients usually employed in zinc electroplating baths. Zinc electroplating baths of different types are conventional and, generally speaking, contain zinc ions and a conductive acid, base, or salt.

Acid zinc plating baths can be formed, for example, by dissolving a zinc salt such as a sulfate, sulfamate, or chloride in an aqueous solution along with a noncomplexing acid such as sulfuric, hydrochloric, or sulfamic acid. Mixtures of zinc salts, for example, zinc sulfate and zinc chloride can be employed if desired. Acid zinc plating baths can also be based on zinc fluoroborate.

Acid zinc baths may also contain various other additives or agents. In some cases a particular additive or agent may be useful for more than one purpose. Examples of additional ingredients which can be employed in acid zinc baths include buffers and bath modifiers such as boric acid, acetic acid, benzoic acid, salicylic acid, and ammonium chloride and the like. Carriers such as polyoxylated alkanols, hydroxyaryl compounds, acetylenic glycols, or sulfonated naphthalene derivatives might be used. Aromatic carbonyl compounds or nicotinate quaternaries may also be used to enhance leveling and brightness. Acid zinc baths may also contain conductive salts, such as ammonium sulfate, ammonium chloride or bromide, sodium chloride, potassium chloride, ammonium fluoroborate, magnesium sufate, and the like, to improve the conductivity of the bath. Additives to control the pH of the bath, such as boric acid, ammonium sulfate, and the like, may also be included. Additional additives such as aluminum sulfate, dextrin, licorice, glucose, polyacrylamides, thiourea and derivatives, or the like may also be added to the bath to improve the crystal structure of the zinc plate obtained and provide a wider operating range of current density.

Alkaline cyanide-free zinc baths are usually formed from a zinc salt such as an oxide or sulfate salt and a strong base such as sodium or potassium hydroxide. The predominant zinc species in the bath at high pH ranges is the zincate anion. It will be appreciated that as used herein, the term "zinc ion" includes zincate or other ionic species of zinc useful in electroplating baths for electroplating metallic zinc therefrom. Cyanide containing alkaline baths are usually formed from a zinc salt such as zinc oxide, a strong base such as sodium or potassium hydroxide, and varying amounts of sodium or potassium cyanide. Both cyanide-containing and cyanide-free, alkaline baths are well known in the art and have been commonly used for years.

In addition to the above mentioned ingredients, alkaline zinc plating baths may contain various additional ingredients. For example, alkaline zinc plating baths may contain buffers such as sodium or potassium carbonates. Also, aromatic aldehydes, nicotinate quaternaries, polyvinyl alcohol, or gelatin may be added to the baths for various purposes as is well known in the art.

The pH of the various zinc electroplating baths can be adjusted by the addition of a suitable agent such as the parent acid of the zinc salt in the bath, ammonium hydroxide, sodium or potassium carbonate, zinc carbonate, sodium or potassium hydroxide, boric acid or the like. Acid zinc plating baths of the present invention are, generally speaking, operable over a broad pH range of 0 to about 6. Alkaline zinc baths of the present invention are operable over a pH range of about 9 to about 14. However, even neutral pH baths (pH 6–9) may be utilized if chelating agents for zinc are used therein.

Zinc plating baths of the present invention can be employed over a broad range of temperatures. In use, the temperature of operation of the bath can be between about 50° F. and 160° F. but is preferably between 65° F. and 105° F., depending on what type of bath is utilized.

In addition to the above components, an electroplating bath of the present invention includes a brightening amount of an organic brightening additive selected from the group consisting of a compound of the following general formula and polymers thereof:

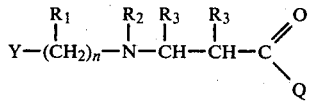

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

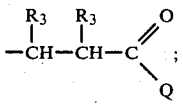

$R_3$ is H or an alkyl group having from 1 to about 4 carbon atoms, phenyl, substituted-phenyl, or

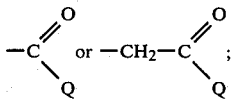

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

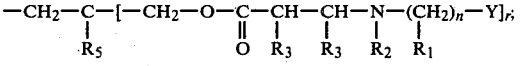

$R_5$ is H, —OH, or a hydroxyalkyl group having from 1 to about 4 carbon atoms;

r is 1 to about 3;

and mixtures thereof.

Monomers and polymers of the above general formula are useful in accordance with this invention. Polymers are preferred for use herein, but the exact molecular weight of the polymer or degree of polymerization is not believed to be critical. The brightening additive must, however, be water soluble, which sets a functional upper limit of molecular weight or degree of polymerization. Thus, the molecular weight of the brightening additive can vary from the molecular weight of the monomer to a molecular weight at which the polymer is water insoluble.

Brightening additives of the present invention can be made by the Michael Reaction, for example, by reacting a conjugated carbonyl compound, preferably a carboxylic derivative such as an acrylic derivative, with a 1° or 2° amine (or its derivatives) without a basic catalyst and preferably in a polar solvent in an exothermic reaction.

The polymer can then be made by heating for polymerization, after which unwanted by-products can be removed by an appropriate means such as by distillation. The polymer product is a cross-linked polymer which generally is a thick jelly, soluble in water.

Organic compounds of the above general formula and methods for making them are disclosed in Ogata et al., "The Reaction of Amino Alcohols With Acrylates," *Bulletin of the Chemical Society of Japan,* Vol. 39, 1486–1490 (1966); Sanui et al., "The Catalytic Effect of Alcohol and Mercaptan on the Michael Reaction of Acrylates," *Bulletin of the Chemical Society of Japan,* Vol. 40, 1727 (1967); Ogata et al. "A Novel Synthesis of polyamide from Amino Alcohol and Acrylate," *Polymer Letters,* Vol. 4, 273–276 (1966); and Ogata et al. "Room-Temperature Polycondensation of β-Amino Acid Derivatives VI. Synthesis of Various N-(Hydroxyethyl) Nylons*," *Journal of Polymer Science: Part A*-1, Vol. 7, 2817–2858 (1969).

Specific brightening additives of the present invention which are preferred for use herein include:

Poly[N-(2-hydroxyethyl) nitrilo di-(ethylpropionate)];
Poly[N-(2-hydroxyethyl) nitrilo di-(N'-(2-hydroxyethyl) propionamide];
Poly[N-(2-hydroxyethyl)-N-(2-cyanoethyl)-β-amino propionic acid];
Tetra[N-methyl N-cyanomethyl β-amino propionate] pentaerythritol;
Poly[N-(hydroxy tert-butyl)β-amino β-methylcarboxy methyl propionate];
Poly[N-(2-hydroxypropyl)β-amino-α-methyl aceto methyl propionate];
Poly[N-(2-hydroxyethyl)β-amino-β-phenyl methyl propionate];
Poly[β-tauryl ethyl propionate];
Poly[N,N-di(2-hydroxyethyl)nitrilo β-methyl propionamide];
Poly[N-(3-hydroxypropyl)β-aminopropionamide-(N'-isopropyl-sodium sulfonate];
Poly[N-(2-mercaptoethyl) nitrilo di(methyl propionate)];
Poly[N-(2-carboxyethyl)β-amine di(butyl propionate)];
Poly[N-(hydroxyethyl aminoethyl)β-amino(2-methoxyethyl) propionate];
Poly[N-(2-hydroxyethyl) nitrilo di-(2-ethyl hexyl propionate)];
N-(2-hydroxypropyl) nitrilo di-(polyethoxy propionate) where the molecular weight of the polyether group is 2000–4000;
Tetra[N-(2-hydroxyethyl)-β-amino propionate] pentaerythritol;
and mixtures thereof.

The concentration of brightening additive employed in a plating bath of this invention can vary over a broad range. The maximum amount of the brightening additive in the bath depends upon the specific additive and may be up to the limit of its solubility in the aqueous plating bath. The minimum amount of brightening additive in the bath depends upon the specific additive and factors such as the current density of the plating process. Generally speaking, the brightening additive must be employed in sufficient concentration effective to obtain the brightening effect desired. For most common purposes, the brightening additive of the present invention will be present in the bath in an amount of from 0.015 to 2.0 g/l. However, at very low current density rates, the additive can be effective in very small amounts, for example, at 0.1 mg/l and at very high rates at concentrations as high as 10 g/l.

In accordance with the method of the present invention, a zinc deposit is electrodeposited from a zinc electroplating bath comprising the above described brightening additive in an amount effective to obtain a desirable zinc deposit. The process of zinc plating of the present invention is useful for decorative or industrial zinc plating such as electrowinning, electrorefining, strip plating, conduit plating, wire plating, rod plating, tube or coupling plating, and so forth. Each application will require a specific form of electrolyte to be used.

The electrodeposition of zinc from the bath is carried out in the older conventional or newer high speed functional methods with cathode current densities of 100–2000 amp/ft$^2$. The electroplating baths of the present invention may be used over a wide range of operating conditions since the brightening additives of the present invention can enhance the deposit of a ductile bright zinc plate over a wide range of pH, temperature and current density conditions. In addition, it is an advantage of the present invention that the brightening agents have a long working life and hence, baths of this invention can be economically employed.

Generally, the zinc plate will be electrodeposited from the zinc electroplating bath using an average cathode current density of from about 1 to 10,000 amp/ft$^2$ (ASF) with bath temperatures within the range of from about 50° F. to about 160° F. The maximum cathode current density applicable is dependent upon the particular type of zinc electrolyte employed. The bath may be agitated with air or agitated mechanically during plating or the workpieces may themselves be mechanically moved if such is desired. Alternatively, the plating solution may be pumped to create turbulence.

The zinc plate produced by the method of the present invention is normally ductile and bright. However, it will be appreciated that some platers may only desire a semi-bright zinc plate, making it possible to use only an amount of brightener effective to make a semi-bright zinc plate, thus economizing on the amount of brightener employed.

The following examples are set forth to further illustrate the present invention and the manner in which the invention may be carried out. The examples are set forth to exemplify the present invention.

EXAMPLE I

An aqueous acid zinc plating bath was formulated containing the following ingredients in the amounts indicated:

| | |
|---|---|
| Zinc Sulfate Monohydrate | 187 g/l |
| Boric Acid | 23 g/l |
| Poly[N—(hydroxy-tert-butyl)-β-amino-β-(methyl carboxy) methyl propionate] | 0.7 g/l |

The bath was air agitated, had a pH of about 3.5 and had a temperature of about 80° F. A bright zinc electroplate was obtained on steel cathodes by electrolyzing the bath at a cathode current density of 80 ASF. The zinc electroplate obtained was bright and ductile.

EXAMPLE 2

An aqueous acid zinc plating bath was formulated containing the following ingredients in the amounts indicated:

| | |
|---|---|
| Zinc Sulfate Monohydrate | 150 g/l |
| Ammonium Sulfate | 20 g/l |
| Tetra[N—methyl-N—cyanomethyl-β-amino propionate] pentaerythritol | 1.2 g/l |

The bath was air agitated, has a pH of about 4.5, and had a temperature of about 70° F. A bright zinc electroplate was obtained on steel cathodes by electrolyzing the bath at a cathode current density of 40 ASF. The zinc electroplate obtained was bright and ductile.

EXAMPLE 3

An aqueous acid zinc plating bath was formulated containing the following ingredients in the amounts indicated:

| | |
|---|---|
| Zinc Fluoroborate | 206 g/l |
| Poly[N—(2-hydroxyethyl) nitriol-di (N'—(2-hydroxyethyl propionamide)] | 0.1 g/l |

The bath was air agitated, had a pH of about 3.0 and had a temperature of about 120° F. A bright zinc electroplate was obtained on steel cathodes by electrolyzing the bath at a cathode current density of 100 ASF. The zinc electroplate obtained was bright and ductile.

EXAMPLE 4

An aqueous acid zinc plating bath was formulated containing the following ingredients in the amounts indicated:

| | |
|---|---|
| Zinc Chloride | 110 g/l |
| Ammonium Chloride | 210 g/l |
| Poly[N—(2-hydroxyethyl) nitrilo di-(ethylpropionate)] | 1.5 g/l |

The bath was air agitated, had a pH of about 5.5 and had a temperature of about 75° F. A zinc electroplate was obtained on steel cathodes by electrolyzing the bath at a cathode current density of 30 ASF. The zinc electroplate obtained was semi-bright and ductile.

EXAMPLE 5

An aqueous acid zinc plating bath was formulated containing the following ingredients in the amounts indicated:

| | |
|---|---|
| Zinc Sulfate Monohydrate | 250 g/l |
| Poly[N—(3-hydroxypropyl)-β-amino propionamide (N'—isopropyl sodium sulfonate)] | 1.5 g/l |

The pH of the bath was about 1.5 and the temperature was about 95° F. Insoluble lead anodes were used because of the low pH. A zinc deposit was obtained on steel cathodes by electrolyzing the bath at a cathode current density of about 160 ASF. The zinc electroplate obtained was semi-bright to bright and is ductile.

EXAMPLE 6

An aqueous acid zinc plating bath was formulated containing the following ingredients in the amounts indicated:

| | |
|---|---|
| Zinc Sulfate Monohydrate | 308 g/l |

-continued

| | |
|---|---|
| Poly[N—(2-hydroxyethyl) nitrilo di-(ethyl propionate)] | 1.4 g/l |

The bath was used for plating wire in an air agitated high speed cell at a temperature of about 90° F. and a a solution flow rate of about 200 ft. per minute. The bath had a pH of about 2 and the wire was zinc plated about 2000 ASF current density. The zinc plate deposited on the wire was bright and ductile.

EXAMPLE 7

An aqueous acid zinc plating bath was formulated containing the following ingredients in the amounts indicated:

| | |
|---|---|
| Zinc Fluoroborate | 300 g/l |
| Tetra[N—(2-hydroxyethyl)β-amino propionate] pentaerythritol | 2.2 g/l |

The bath was employed in a high speed cell to plate tubing. The bath had a pH of about 2.5 and a temperature of about 80° F. Zinc electroplate was deposited from the bath with solution counter flow of about 12 ft. per second and at about 4000 ASF current density. The zinc electroplate on the tubing was bright, uniform and ductile.

EXAMPLE 8

An aqueous alkaline zinc plating bath was formulated containing the following ingredients in the amounts indicated:

| | |
|---|---|
| Zinc oxide | 10 g/l |
| Sodium hydroxide | 80 g/l |
| Sodium carbonate | 30 g/l |
| Poly[N—(2-hydroxyethyl) nitrilo di-(ethyl propionate)] | 2.8 g/l |

A Hull Cell panel was plated at 2 amps for 5 minutes at 75° F. The panel illustrated cathode current densities from 1–80 ASF and above and was totally bright all the way across.

EXAMPLE 9

An aqueous alkaline zinc plating bath was formulated containing the following ingredients in the amounts indicated:

| | |
|---|---|
| Zinc oxide | 45 g/l |
| Sodium hydroxide | 75 g/l |
| Sodium cyanide | 88.5 g/l |
| Poly[N—(2-hydroxyethyl) nitrilo di-(ethyl propionate)] | 2.7 g/l |

A Hull Cell panel was plated at 2 amps for 5 minutes at 78° F. The panel illustrated cathode current densities from 1–80 ASF and above and was fully bright all the way across.

While the above disclosure sets forth and describes various embodiments of the present invention, the compositions and methods described are intended to illustrate but not limit the present invention. It will be understood that the specific embodiments described herein are subject to variation and modification by one skilled in the art having benefit of the present disclosure. Therefore, it is intended that the present invention is to be limited solely by the following claims.

What is claimed is:

1. A zinc electroplating bath comprising a conductive aqueous solution containing zinc ions and a brightening amount of a water soluble brightening additive selected from the group consisting of a monomer of the following general formula and polymers thereof:

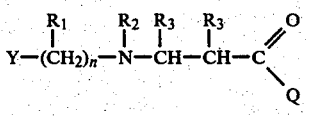

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

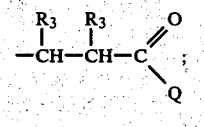

$R_3$ is H or an alkyl group having from 1 to about 4 carbon atoms, phenyl, substituted-phenyl, or

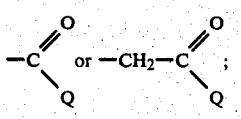

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

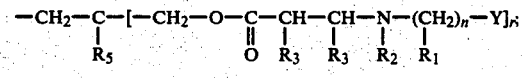

$R_5$ is H, —OH, or a hydroxyalkyl group having from 1 to about 4 carbon atoms;

r is 1 to about 3;

and mixtures thereof.

2. The bath of claim 1 wherein said brightening additive is selected from the group consisting of:

Poly[N-(2-hydroxyethyl) nitrilo di-(ethylpropionate)];

Poly[N-(2-hydroxyethyl) nitrilo di-(N'-(2-hydroxyethyl) propionamide];

Poly[N-(2-hydroxyethyl)-N-(2-cyanoethyl)-β-amino propionic acid];

Tetra[N-methyl N-cyanomethyl β-amino propionate] pentaerythritol;

Poly[N-(hydroxy tert-butyl)β-amino β-methylcarboxy methyl propionate];

Poly[N-(2-hydroxypropyl)β-amino-α-methyl aceto methyl propionate];

Poly[N-(2-hydroxyethyl)β-amino-β-phenyl methyl propionate];

Poly[β-tauryl ethyl propionate];

Poly[N,N-di(2-hydroxyethyl)nitrilo β-methyl propionamide];

Poly[N-(3-hydroxypropyl)β-aminopropionamide-(N'-isopropyl-sodium sulfonate];

Poly[N-(2-mercaptoethyl) nitrilo di(methyl propionate)];

Poly[N-(2-carboxyethyl)β-amine di(butyl propionate)];

Poly[N-(hydroxyethyl aminoethyl)β-amino(2-methoxyethyl) propionate];

Poly[N-(2-hydroxyethyl) nitrilo di-(2-ethyl hexyl propionate)];

N-(2-hydroxypropyl) nitrilo di-(polyethoxy propionate) where the molecular weight of the polyether group is 2000–4000;

Tetra[N-(2-hydroxyethyl β-amino propionate] pentaerythritol;

and mixtures thereof.

3. The bath of claim 1 or 2 wherein said brightening additive is present in an amount of from about 0.1 mg/l to about 10 g/l.

4. The bath of claim 1 or 2 wherein said brightening additive is present in an amount of from about 0.015 g/l to about 2 g/l.

5. The bath of claim 1 or 2 wherein said bath has a pH of from about 0 to about 6.

6. The bath of claim 1 or 2 wherein said bath has a pH of from about 9 to about 14.

7. The bath of claim 1 or 2 wherein said bath has a pH of from about 6 to about 9 and contains chelating agents to keep the zinc ions in solution.

8. A process for electroplating a zinc deposit onto a substrate comprising electrodepositing zinc from a conductive aqueous solution containing zinc ions and a brightening amount of a water soluble brightening additive selected from the group consisting of a monomer of the following general formula and polymers thereof:

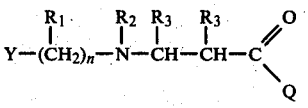

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

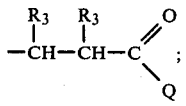

$R_3$ is H or an alkyl group having from 1 to about 4 carbon atoms, phenyl, substituted-phenyl, or

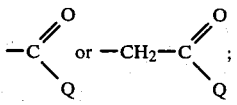

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

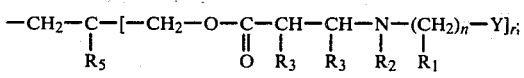

$R_5$ is H, —OH, or a hydroxyalkyl group having from 1 to about 4 carbon atoms;

r is 1 to about 3;

and mixtures thereof.

9. The process of claim 8 wherein said brightening additive is selected from the group consisting of:

Poly[N-(2-hydroxyethyl) nitrilo di-(ethylpropionate)];

Poly[N-(2-hydroxyethyl) nitrilo di-(N'-(2-hydroxyethyl) propionamide];

Poly[N-(2-hydroxyethyl)-N-(2-cyanoethyl)-β-amino propionic acid];

Tetra[N-methyl N-cyanomethyl β-amino propionate] pentaerythritol;

Poly[N-(hydroxy tert-butyl)β-amino β-methylcarboxy methyl propionate];

Poly[N-(2-hydroxypropyl)β-amino-α-methyl aceto methyl propionate];

Poly[N-(2-hydroxyethyl)β-amino-α-phenyl methyl propionate];

Poly[β-tauryl ethyl propionate];

Poly[N,N-di(2-hydroxyethyl)nitrilo β-methyl propionamide];

Poly[N-(3-hydroxypropyl)β-aminopropionamide-(N'-isopropyl-sodium sulfonate];

Poly[N-(2-mercaptoethyl) nitrilo di(methyl propionate)];

Poly[N-(2-carboxyethyl)β-amine di(butyl propionate)];

Poly[N-(hydroxyethyl aminoethyl)β-amino(2-methoxyethyl) propionate];

Poly[N-(2-hydroxyethyl) nitrilo di-(2-ethyl hexyl propionate)];

N-(2-hydroxypropyl) nitrilo di-(polyethoxy propionate) where the molecular weight of the polyether group is 2000–4000;

Tetra[N-2-hydroxyethyl)-β-amino propionate] pentaerythritol;

and mixtures thereof.

10. The process of claim 8 or 9 wherein said brightening additive is present in an amount of from about 0.1 mg/l to about 10 g/l.

11. The process of claim 8 or 9 wherein said brightening additive is present in an amount of from about 0.015 g/l to about 2 g/l.

12. The process of claim 8 or 9 wherein said bath has a pH of from about 0 to about 6.

13. The process of claim 8 or 9 wherein said bath has a pH of from about 9 to about 14.

14. The process of claim 8 or 9 wherein said bath has a pH of from about 6 to about 9 and contains a chelating agent in an amount effective to keep zinc ions in solution.

15. The process of claim 8 or 9 wherein said electrodepositing is carried out at a high cathode current density of from about 100 to about 10,000 ASF.

16. The process of claim 8 or 9 wherein said bath has a pH of from about 0 to about 6 and said electrodepositing is carried out at a high cathode current density of from about 100 to about 10,000 ASF.

* * * * *

UNITED STATES PATENT AND TRADEMARK OFFICE

CERTIFICATE OF CORRECTION

PATENT NO. : 4,397,718

DATED : August 9, 1983

INVENTOR(S) : Sylvia Martin

It is certified that error appears in the above-identified patent and that said Letters Patent are hereby corrected as shown below:

In Column 1, lines 53-56;
In Column 4, lines 2-5;
In Column 9, lines 11-14; and
In Column 10, lines 48-51; the general formula depicted should appear as follows:

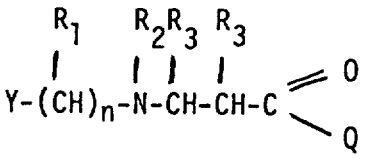

UNITED STATES PATENT AND TRADEMARK OFFICE

CERTIFICATE OF CORRECTION

PATENT NO. : 4,397,718

DATED : August 9, 1983

INVENTOR(S) : Sylvia Martin

It is certified that error appears in the above-identified patent and that said Letters Patent is hereby corrected as shown below:

In Column 2, lines 27-29;
In Column 4, lines 44-46;
In Column 9, lines 53-55; and
In Column 11, lines 24-26; the formula depicted should appear as follows:

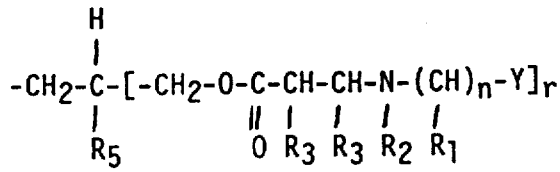

Signed and Sealed this

Twenty-second Day of April 1986

[SEAL]

Attest:

DONALD J. QUIGG

Attesting Officer

Commissioner of Patents and Trademarks